US009359843B2

(12) United States Patent
Tonti et al.

(10) Patent No.: US 9,359,843 B2
(45) Date of Patent: Jun. 7, 2016

(54) ANCHORING SYSTEM AND METHOD OF ANCHORING AND UNANCHORING THE SAME

(71) Applicants: Nicholas K. Tonti, Pearland, TX (US); Stephen James, Pearland, TX (US)

(72) Inventors: Nicholas K. Tonti, Pearland, TX (US); Stephen James, Pearland, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 256 days.

(21) Appl. No.: 13/708,240

(22) Filed: Dec. 7, 2012

(65) Prior Publication Data

US 2014/0158375 A1 Jun. 12, 2014

(51) Int. Cl.
*E21B 23/04* (2006.01)

(52) U.S. Cl.
CPC ..... *E21B 23/04* (2013.01)

(58) Field of Classification Search
USPC ..... 166/382, 212
See application file for complete search history.

(56) References Cited

U.S. PATENT DOCUMENTS

| | | | | |
|---|---|---|---|---|
| 3,758,145 | A * | 9/1973 | Kinley | 294/86.29 |
| 4,059,150 | A * | 11/1977 | Manderscheid | 166/120 |
| 4,359,090 | A * | 11/1982 | Luke | 166/217 |
| 4,697,523 | A * | 10/1987 | Saxby | 102/440 |
| 4,901,794 | A | 2/1990 | Baugh et al. | |
| 5,350,013 | A | 9/1994 | Jani et al. | |
| 5,586,601 | A | 12/1996 | Pringle | |
| 6,360,821 | B1 * | 3/2002 | Braddick | 166/117.6 |
| 2005/0194151 | A1 | 9/2005 | Dewey et al. | |
| 2010/0126725 | A1 | 5/2010 | Ravensbergen | |
| 2011/0030971 | A1 * | 2/2011 | Braddick | E21B 31/18 166/380 |
| 2011/0253386 | A1 | 10/2011 | Brandt et al. | |

OTHER PUBLICATIONS

M. Grinrod, "A Shallow Gas Research Program"; IADC/SPE; Conference Paper 17256; 1988 IADC/SPE Drilling Conference, Feb. 28-Mar. 2, 1988; pp. 629-639.

Greg Nazzal, et al., "Development, Testing and Field Theory of a True One Trip Casing Exit System", Society of Petroleum Engineers; Meeting Paper 35662; SPE Western Regional meeting, May 22-24, 1996; pp. 135-144.

International Search Report and Written Opinion; International Application No. PCT/US2013/068065; International Filing Date: Nov. 1, 2013; Date of Mailing: Feb. 14, 2014; 10 pages.

* cited by examiner

*Primary Examiner* — Taras P Bemko
(74) *Attorney, Agent, or Firm* — Cantor Colburn LLP

(57) ABSTRACT

An anchoring system includes a housing having a radial opening therein, and a piston disposed within the housing which is axially movable therein. A slip is in operable communication with the piston such that movement of the piston in a first axial direction relative to the housing causes movement of the slip in a first radial direction relative to the housing to anchor the anchoring system to a structure and movement of the piston in a second axial direction allows the slip to move in a second radial direction that allows unanchoring of the anchoring system. A sleeve is configured to cause movement of the piston in the second axial direction when moved in the second axial direction relative to the housing, in response to either mechanically pulling the sleeve in the second axial direction or increasing pressure applied against the piston.

12 Claims, 1 Drawing Sheet

ANCHORING SYSTEM AND METHOD OF ANCHORING AND UNANCHORING THE SAME

BACKGROUND

Typical anchoring systems that fixedly attach a tool to a position within a structure are available and many adequately serve the function for which they were designed. There are times, however, when an operator wishes to remove an anchor after it has been set within a structure. This typically requires drilling or milling the anchoring system out from within the structure. The art is receptive to systems and methods of unanchoring a system after it has been anchored without drilling and milling.

BRIEF DESCRIPTION

Disclosed herein is an anchoring system including a housing having a radial opening therein, and a piston disposed within the housing which is axially movable therein. A slip is in operable communication with the piston such that movement of the piston in a first axial direction relative to the housing causes movement of the slip in a first radial direction relative to the housing to anchor the anchoring system to a structure and movement of the piston in a second axial direction allows the slip to move in a second radial direction that allows unanchoring of the anchoring system. A sleeve in operable communication with the housing and the piston is configured to cause movement of the piston in the second axial direction when moved in the second axial direction relative to the housing, where the sleeve is movable in the second axial direction relative to the housing in response to either mechanically pulling the sleeve in the second axial direction or increasing pressure applied against the piston.

Further disclosed is a method of anchoring and unanchoring an anchoring system. The system includes hydraulically urging a piston in a first axial direction relative to a housing, hydraulically urging a sleeve in operable communication with the piston in the first axial direction, and moving a slip in a first radial direction relative to the housing and engaging the slip with a structure. The method also includes mechanically or hydraulically urging the sleeve in a second axial direction relative to the housing, urging the piston in a second axial direction, moving the slip in a second radial direction, and disengaging the slip from the structure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
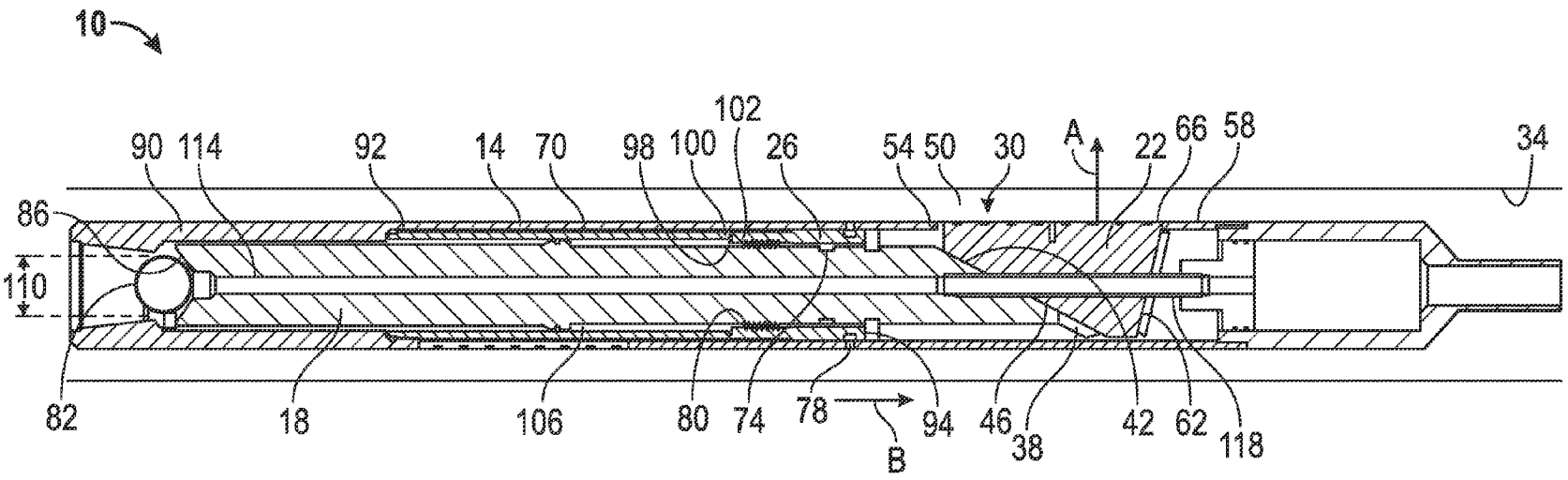
FIG. 1 depicts a cross sectional side view of an anchoring system disclosed herein.
Figure 2:
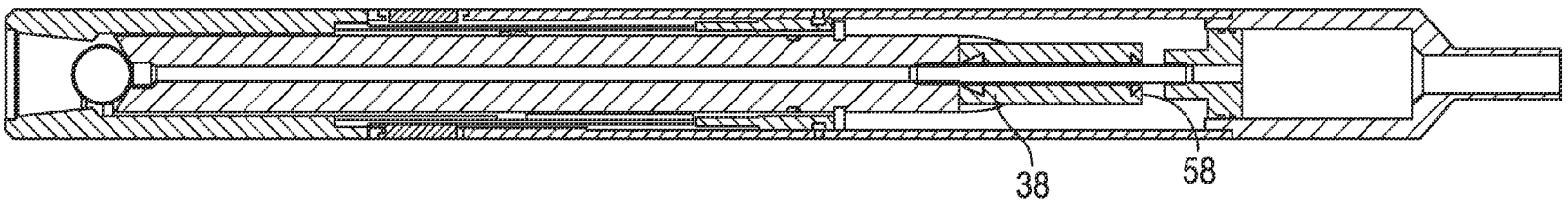
FIG. 2 depicts an alternate cross sectional side view of the anchoring system of FIG. 1.

Referring to FIGS. 1 and 2, an embodiment of an anchoring system disclosed herein is illustrated at 10. The anchoring system 10 among other things includes a housing 14, a piston 18, a slip 22 and a sleeve 26. The housing 14 has radial opening 30 therein through which the slip 22 is radially movable in response to axial movement of the piston 18 relative to the housing 14. Specifically, the slip 22 is primarily radially movable in a first radial direction, to anchorably engage the anchoring system 10 to a structure 34, in response to the piston 18 moving primarily axially in a first axial direction. The first radial direction is in the direction of arrow "A" and the first axial direction is in the direction of arrow "B" in FIG. 1. The structure 34 illustrated herein is an open borehole in an earth formation in a hydrocarbon recovery or carbon dioxide sequestration operation, for example, although other structures are contemplated, such as, a casing or a liner. The slip 22 is also radially movable in a second direction, to unanchor the anchoring system 10 from engagement with the structure 34, in response to the piston 18 moving in a second axial direction. The second radial direction being substantially opposite to the first radial direction and the second axial direction being substantially opposite to the first axial direction. The sleeve 26 is axially slidable sealingly engaged with the piston 18 such that movement of the sleeve 26 in the second direction a sufficient dimension causes movement of the piston 18 in the second direction.

In the embodiment illustrated, the slip 22 is slidably engaged with the piston 18 through a dovetail configuration 38 thereby causing an inclined surface 42 of the piston 18 to remain in contact with an angled surface 46 of the slip 22 while the two surfaces 42, 46 are able to slide relative to one another. The dovetail configuration 38 causes the slip 22 to move in the second radial direction in response to the piston 18 moving in the second axial direction as an end 50 of the slip 22 contacts a shoulder 54 of the radial opening 30. An optional second dovetail configuration 58 is employed between a second angled surface 62 of the slip 22 and a second shoulder 66 of the radial opening 30 to provide additional guidance of the slip 22 as it moves in both the first radial direction and the second radial direction. In this embodiment the slip 22 is metallic and includes no polymeric portion.

The sleeve 26 is positioned within an annular space 70 between the housing 14 and the piston 18 and is releasably fixed to both by release members 74, 78, shown herein as shear screws, although alternate releasable devices are contemplated. The release members 74, 78 prevent axial movement between the piston 18 and the housing 14 until a selected load has been attained, to thereby prevent inadvertent setting of the slip 22. Loads applied to the piston 18 in the first axial direction in excess of a selected load cause the release members 74 to release thereby allowing the piston 18 to move relative to the sleeve 26 (and the housing 14) in the first axial direction to thereby set the slip 22 into anchoring engagement with the structure 34. A ratcheting arrangement 80 between the piston 18 and the sleeve 26 prevents the piston 18 from moving in the second axial direction thereby maintaining the slip 22 in engagement with the structure 34. Pressure built against a plug 82, shown in this embodiment as a ball, seated against a seat 86 of the piston 18, generated setting forces in the piston 18 in the first axial direction.

A tubular 90 is attached to the sleeve 26 in this embodiment by a threaded engagement 92. Urging the tubular 90 in the second axial direction thereby causes the same urging on the sleeve 26 in the second axial direction relative to the housing 14 and carried by the release members 78. After sufficient urging force to release the release members 78 is attained the sleeve 26 and the piston 18 are allowed to move in the second axial direction, relative to the housing 14, in response to the urging thereby causing the slip 22 to move in the second radial direction to unanchor the anchoring system 10 from the structure 34. Once unanchored the anchoring system 10 can be withdrawn from the structure 34.

Alternately, unanchoring of the anchoring system 10 from the structure 34 can be initiated through hydraulically instead of via mechanically pulling on the tubular 90. Pressure built against the seated plug 82 acts upon a reduced area of the tubular 90 defined by a radial dimension 110 thereby urging the tubular 90 and the sleeve 34 in the second axial direction relative to the piston 18 and the housing 14 thereby resulting in loading of the release members 78. Upon attainment of the selected release load the release members 78 will release allowing the sleeve 26 to move in the second axial direction relative to the piston 18 and the housing 14. This movement can continue until a shoulder 102 of the sleeve 26 abuts a shoulder 106 of the piston 18, thereby absorbing the loads between the piston 18 and the sleeve 26 due to the pressure. Once the release members 78 are released and the shoulders 102, 106 are abutted any movement of the sleeve 26 in the second axial direction will cause the piston 18 to move in the second axial direction as well, which causes the slip 22 to move in the second radial direction and unanchoring the anchoring system 10 from the structure 34 in the process.

If after release of the release members 78 anchoring system 10 remains stuck within the structure 34 the sleeve 26 itself can be sheared thereby allowing the tubular 90 and the sleeve 26 to be withdrawn from the structure 34 exposing a shoulder 94 of the piston 18 for engagement with a fishing tool (not shown) for later retrieval from the structure 34. The sleeve 26 includes a recess 98 that defines a shearable point 100 of the sleeve 26 that shears at a selected axial load. The shoulder 102 on the sleeve 26 engages with the shoulder 106 on the piston 18 to ensure that axial loads on the sleeve 26 are experienced at the shearable point 100.

The piston 18 includes a bore 114 providing fluidic communication therethrough. This fluidic communication prevents a pressure differential from building across the piston 18 when the plug 82 is not present. Such a pressure differential, if allowed to build, could cause a tube 118, part of which defines the bore 114, passing through the slip 22 to undergo undesirable axial compression thereof. Additionally, the bore 114 allows for fluids to be pumped therethrough such as during a cementing operation, for example, in a completion operation in a hydrocarbon recovery wellbore.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An anchoring system comprising:

a housing having a radial opening therein;

a piston disposed within the housing having a bore therethrough receptive to flow, the piston being axially movable relative to the housing;

a seat disposed on the piston configured to allow pressure differential to build across the piston when a plug is seated against the seat;

a slip in operable communication with the piston such that movement of the piston in a first axial direction relative to the housing causes movement of the slip in a first radial direction relative to the housing to anchor the anchoring system to a structure and movement of the piston in a second axial direction allows the slip to move in a second radial direction that allows unanchoring of the anchoring system; and a sleeve in operable communication with the housing and the piston, configured to cause movement of the piston in the second axial direction when moved in the second axial direction relative to the housing, the sleeve being movable in the second axial direction relative to the housing in response to mechanically pulling the sleeve in the second axial direction wherein the slip is engaged with the piston and the housing such that movement of the piston in the second axial direction urges the slip to move in the second radial direction and wherein the engagement of the slip with at least one of the piston and the housing is through a dovetail arrangement.

2. The anchoring system of claim 1, further comprising a tubular attached to the sleeve such that movement of the sleeve in the second axial direction is facilitated by movement of the tubular in the second axial direction.

3. The anchoring system of claim 1, further comprising a release member in operable communication with the housing and the sleeve to prevent movement of the sleeve until a force sufficient to release the release member has been attained.

4. The anchoring system of claim 1, further comprising a bore through the piston providing fluidic communication through the anchoring system whether the anchoring system is anchored or not.

5. The anchoring system of claim 4, wherein the bore allows pressure on opposing axial sides of the piston to be equalized.

6. A method of anchoring and unanchoring the anchoring system of claim 1 comprising:

plugging a bore through a piston with a plug;

pressuring up against the plugged bore;

hydraulically moving the piston in a first axial direction relative to a housing;

moving a slip in a first radial direction relative to the housing;

engaging the slip with a structure;

mechanically urging the sleeve in the second axial direction relative to the housing;

urging the piston in a second axial direction;

moving the slip in a second radial direction;

disengaging the slip from the structure; and flowing fluid through the bore when the bore is not plugged.

7. The method of anchoring and unanchoring an anchoring system of claim 6, further comprising releasing a release member between the sleeve and the housing with the mechanical urging in the second axial direction.

8. The method of anchoring and unanchoring an anchoring system of claim 6, further comprising maintaining fluidic communication axially through the anchoring system regardless of whether the slip is engaged with the structure or not.

9. The method of anchoring and unanchoring an anchoring system of claim 6, wherein the mechanical urging of the sleeve in the second axial direction is through pulling a tubular engaged with the sleeve.

10. An anchoring system comprising:

a housing having a radial opening therein;

a piston disposed within the housing having a bore therethrough receptive to flow, the piston being axially movable relative to the housing;

a seat disposed on the piston configured to allow pressure differential to build across the piston when a plug is seated against the seat a slip in operable communication with the piston such that movement of the piston in a first axial direction relative to the housing causes movement of the slip in a first radial direction relative to the housing to anchor the anchoring system to a structure and movement of the piston in a second axial direction allows the slip to move in a second radial direction that allows unanchoring of the anchoring system; and a sleeve in operable communication with the housing and the piston, configured to cause movement of the piston in the second axial direction when moved in the second axial direction relative to the housing, the sleeve being movable in the second axial direction relative to the housing in response to mechanically pulling the sleeve in the second axial direction and further comprising a release member in operable communication with the piston and the sleeve that prevents movement of the piston relative to the sleeve in the first axial direction until a force to release the release member has been attained.

11. An anchoring system comprising:

a housing having a radial opening therein;

a piston disposed within the housing having a bore therethrough receptive to flow, the piston being axially movable relative to the housing;

a seat disposed on the piston configured to allow pressure differential to build across the piston when a plug is seated against the seat a slip in operable communication with the piston such that movement of the piston in a first axial direction relative to the housing causes movement of the slip in a first radial direction relative to the housing to anchor the anchoring system to a structure and movement of the piston in a second axial direction allows the slip to move in a second radial direction that allows unanchoring of the anchoring system; and a sleeve in operable communication with the housing and the piston, configured to cause movement of the piston in the second axial direction when moved in the second axial direction relative to the housing, the sleeve being movable in the second axial direction relative to the housing in response to mechanically pulling the sleeve in the second axial direction and further comprising a ratchet arrangement between the piston and the sleeve to prevent movement of the piston in the second axial direction after having moved in the first axial direction.

12. An anchoring system comprising:

a housing having a radial opening therein;

a piston disposed within the housing having a bore therethrough receptive to flow, the piston being axially movable relative to the housing;

a seat disposed on the piston configured to allow pressure differential to build across the piston when a plug is seated against the seat a slip in operable communication with the piston such that movement of the piston in a first axial direction relative to the housing causes movement of the slip in a first radial direction relative to the housing to anchor the anchoring system to a structure and movement of the piston in a second axial direction allows the slip to move in a second radial direction that allows unanchoring of the anchoring system; and a sleeve in operable communication with the housing and the piston, configured to cause movement of the piston in the second axial direction when moved in the second axial direction relative to the housing, the sleeve being movable in the second axial direction relative to the housing in response to mechanically pulling the sleeve in the second axial direction wherein the sleeve is shearable to allow removal of a portion of the sleeve from the anchoring system at loads indicative that a portion of the anchoring system is stuck within the structure.

* * * * *